US006997487B2

(12) United States Patent
Kitzis

(10) Patent No.: US 6,997,487 B2
(45) **Date of Patent: *Feb. 14, 2006**

(54) ANTI-ANIMAL CONTAINER LOCK

(76) Inventor: Roger S. Kitzis, 156 Plainview Rd., Woodbury, NY (US) 11797-2807

( * ) Notice: Subject to any disclaimer, the term of this patent is extended or adjusted under 35 U.S.C. 154(b) by 0 days.

This patent is subject to a terminal disclaimer.

(21) Appl. No.: 10/786,191

(22) Filed: Feb. 25, 2004

(65) Prior Publication Data

US 2004/0164563 A1 Aug. 26, 2004

Related U.S. Application Data

(62) Division of application No. 10/119,358, filed on Apr. 9, 2002, now Pat. No. 6,722,711.

(51) Int. Cl.
*E05C 19/00* (2006.01)

(52) U.S. Cl. ..... 292/1; 411/54

(58) Field of Classification Search ..... 292/1, 292/91, 159, 253, 256, 257, 300, 345, 302, 292/342; 411/54; 269/48.1, 48.2, 48.3
See application file for complete search history.

(56) References Cited

U.S. PATENT DOCUMENTS

| | | | | |
|---|---|---|---|---|
| 2,353,248 | A * | 7/1944 | Lamb | 269/48.2 |
| 2,372,904 | A * | 4/1945 | McCarthy | 269/48.2 |
| 3,426,399 | A * | 2/1969 | Jones | 269/48.1 |
| 5,042,888 | A * | 8/1991 | Shinjo | 411/54 |
| 5,320,364 | A * | 6/1994 | Mistrater et al. | 279/2.17 |
| 5,322,300 | A * | 6/1994 | Mistrater et al. | 279/2.17 |

* cited by examiner

*Primary Examiner*—Gary Estremsky
(74) *Attorney, Agent, or Firm*—Notaro & Michalos P.C.

(57) ABSTRACT

A locking arrangement is for a receptacle and cover with overlapping parts and aligned holes through the overlapping part. A bolt extends into at least one of the holes with a handle at one end of the bolt for pulling the bolt out of the aligned holes in a withdrawing direction. An expansion mechanism at an opposite end of the bolt expands to prevent withdrawing the bolt. The mechanism has a contracted geometry for allowing withdrawing of the bolt. An actuator mounted for movement to the bolt is pushed to contract and unlock the mechanism. A spring biases the expansion mechanism toward the expanded geometry so that when the actuator is not being pushed, the expansion mechanism is in the expanded geometry to lock the cover to the receptacle.

7 Claims, 8 Drawing Sheets

FIG. 1
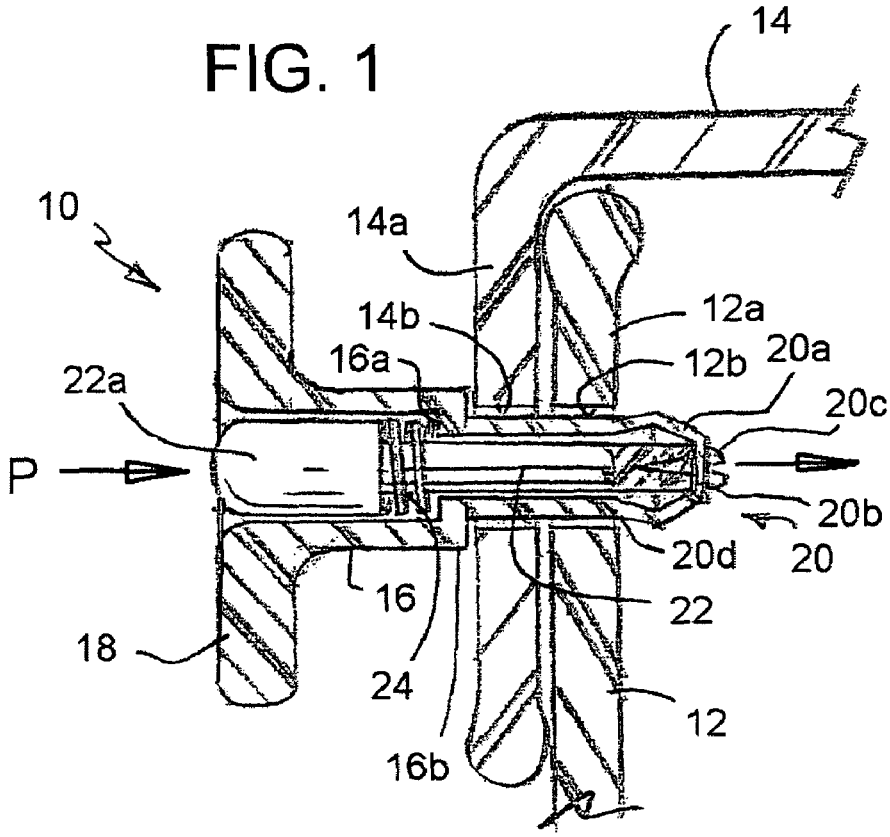
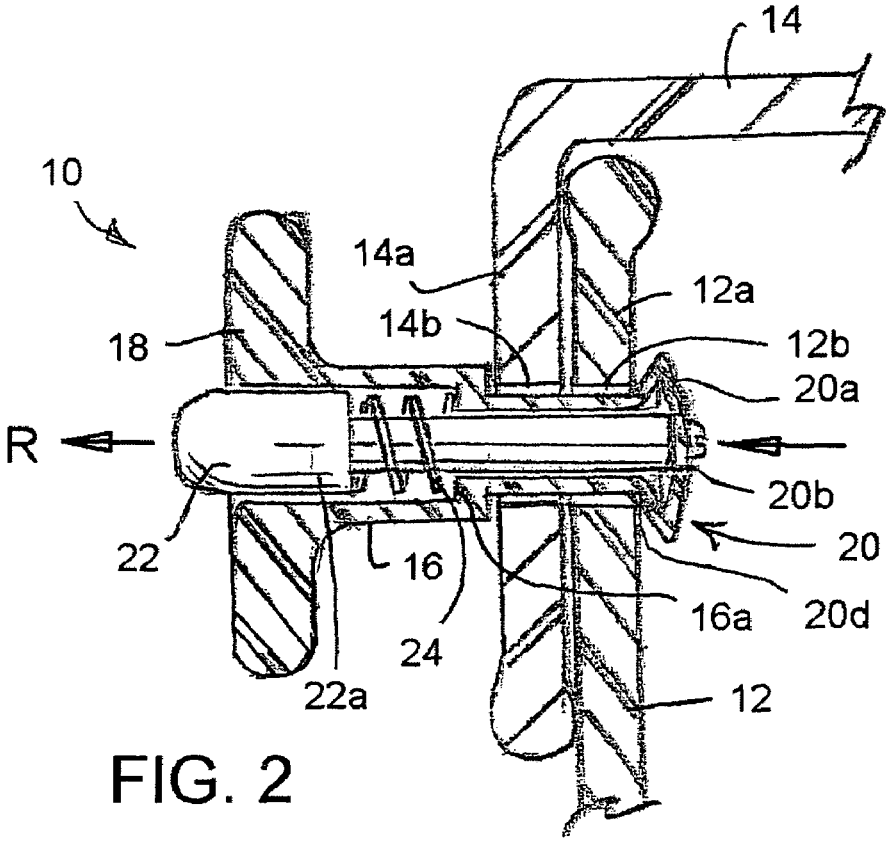
FIG. 2

FIG. 3
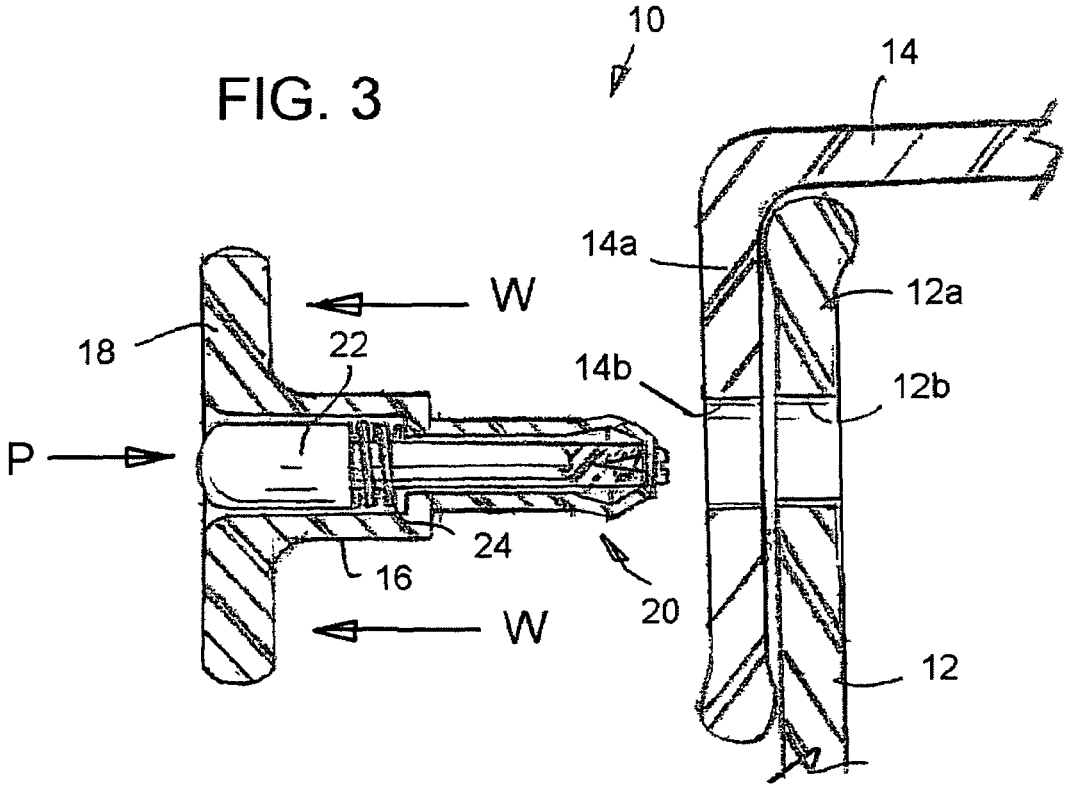
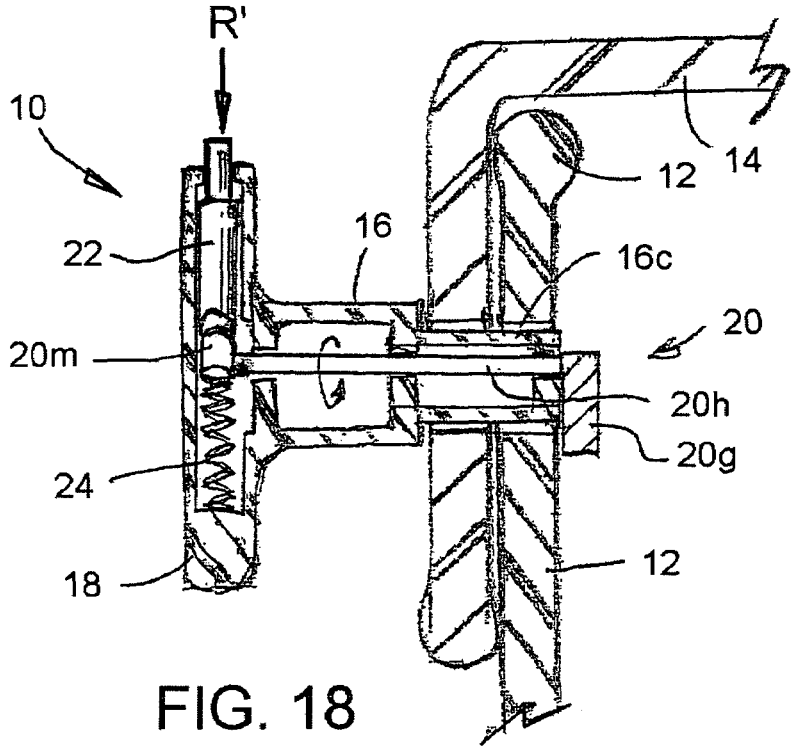
FIG. 18

FIG. 4
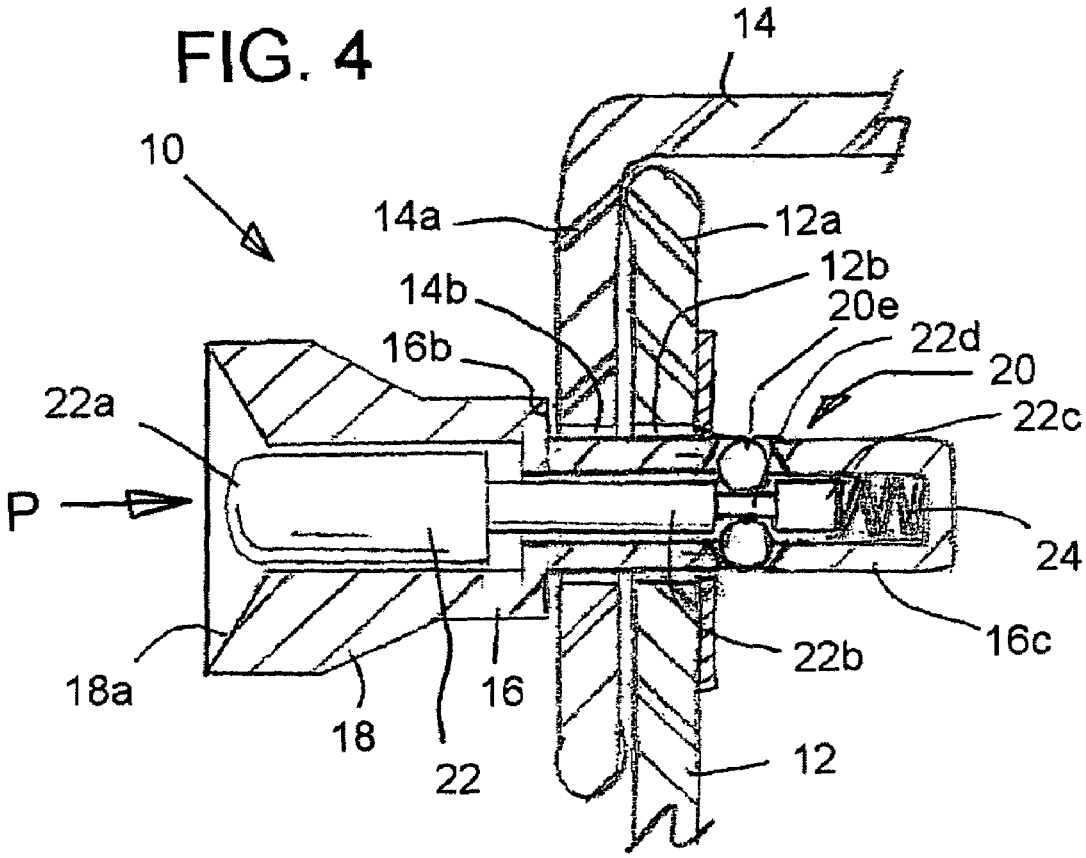
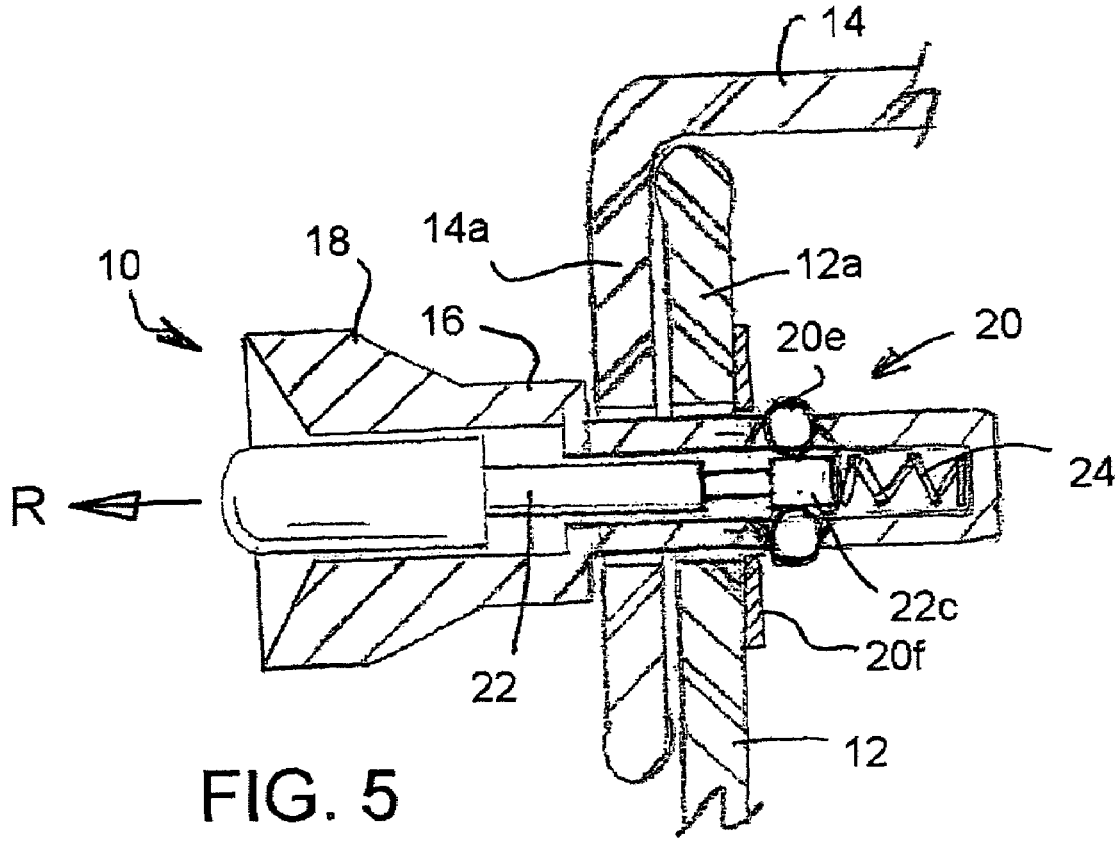
FIG. 5

FIG. 6
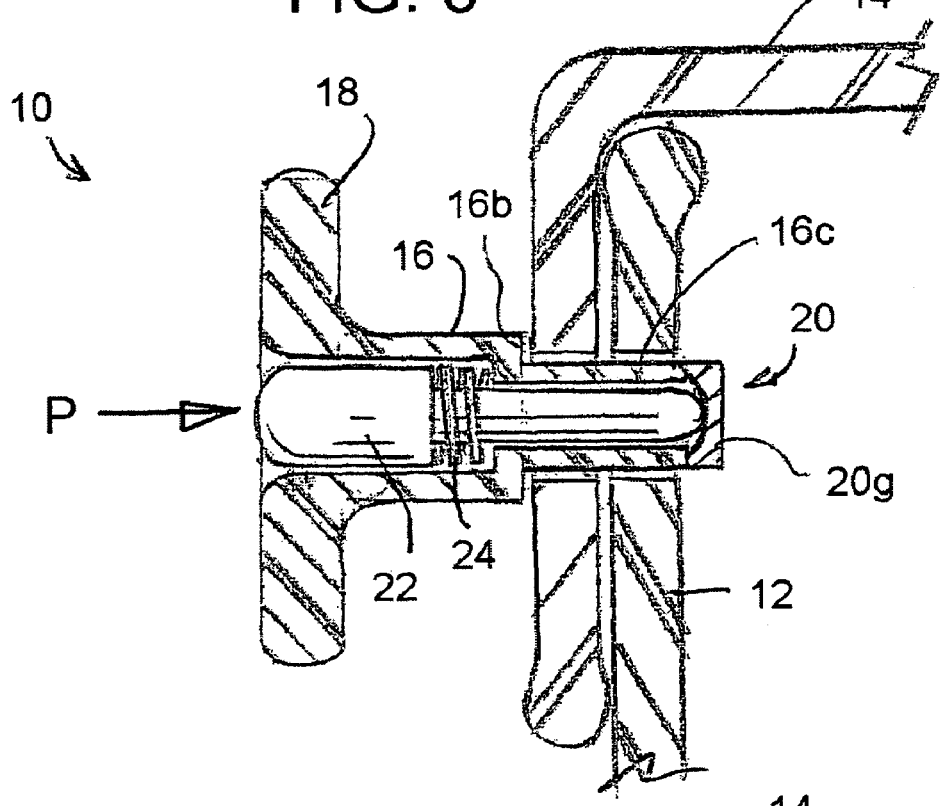
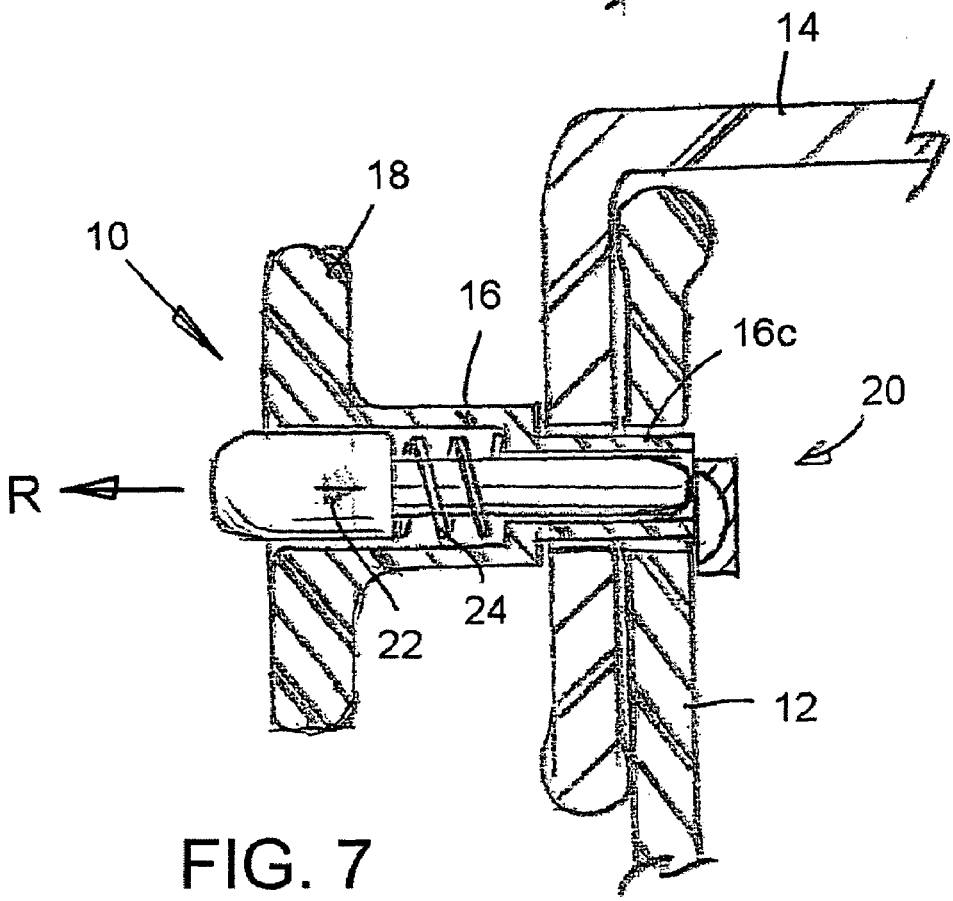
FIG. 7

FIG. 8
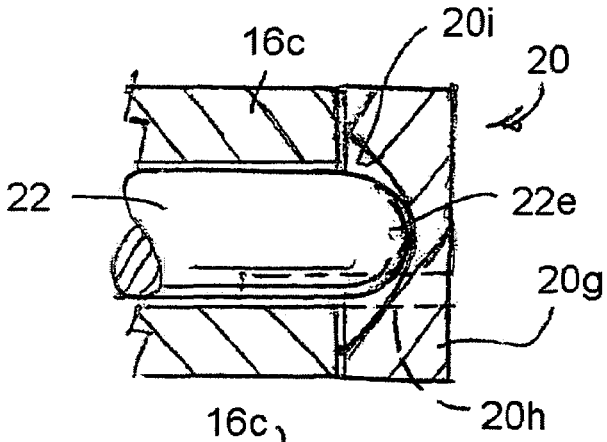
FIG. 9
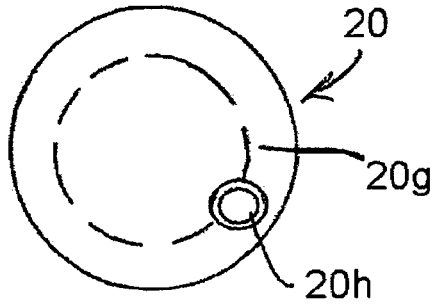
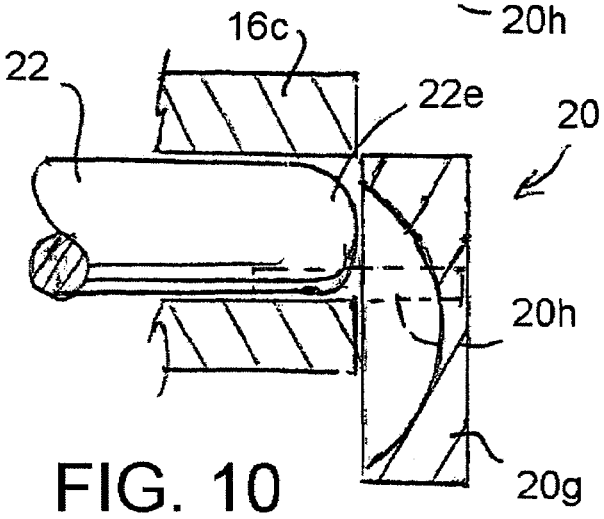
FIG. 10
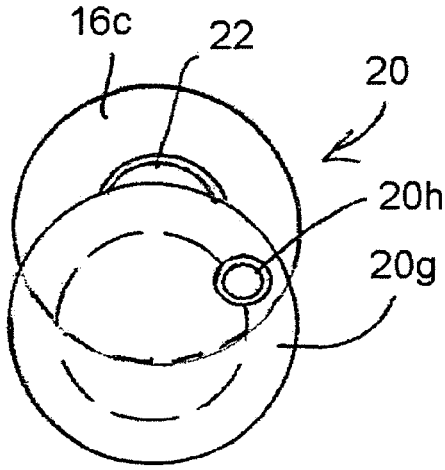
FIG. 11

FIG. 12
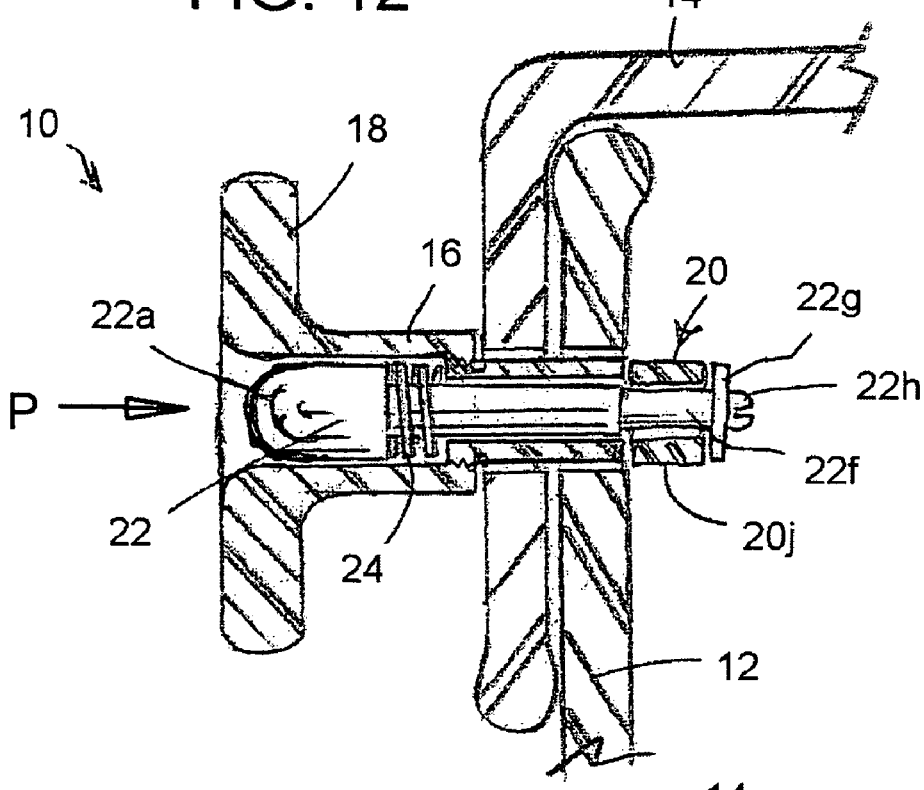
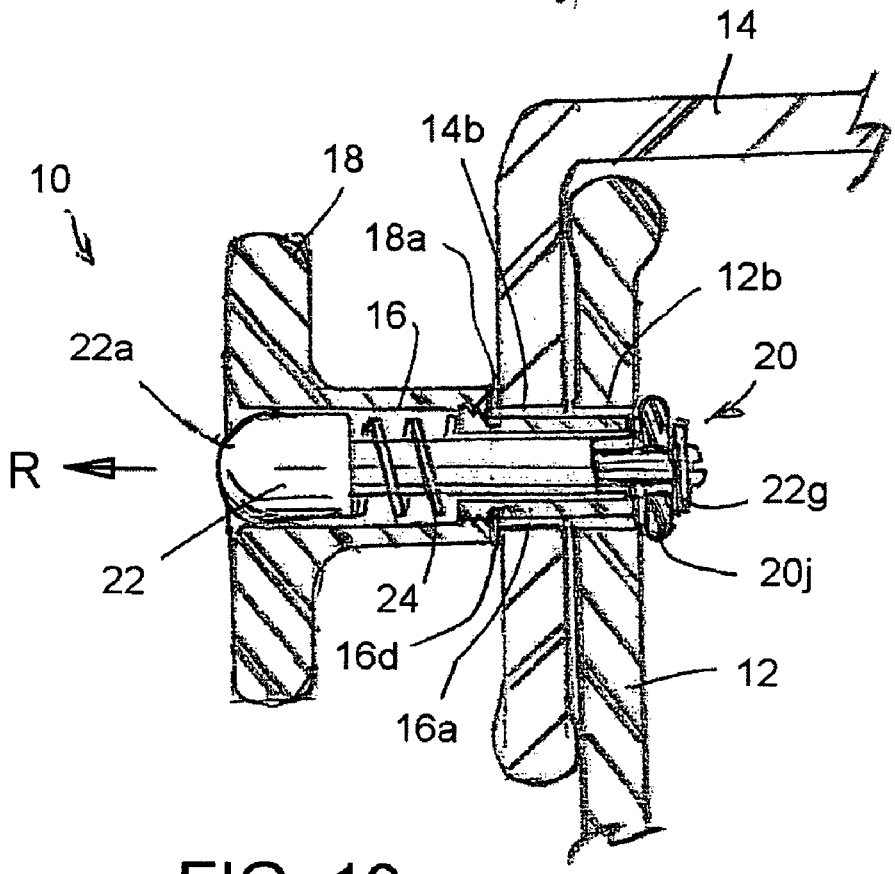
FIG. 13

FIG. 14
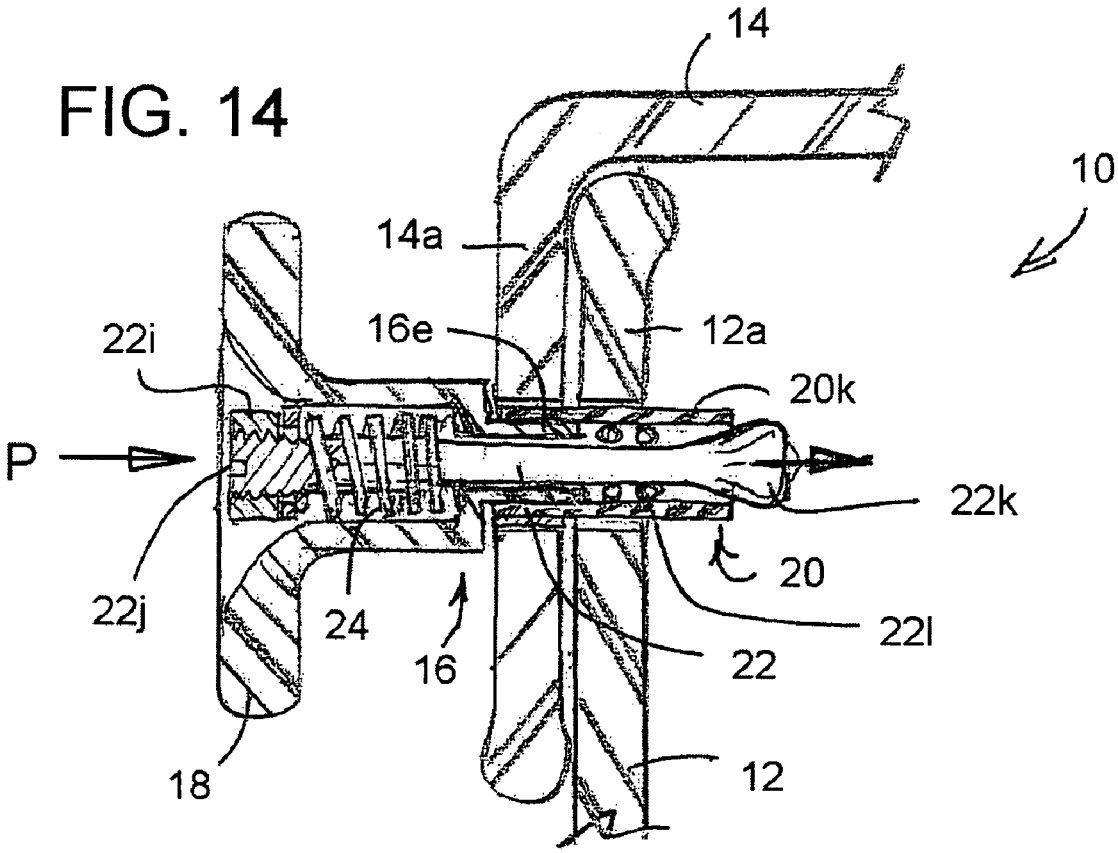
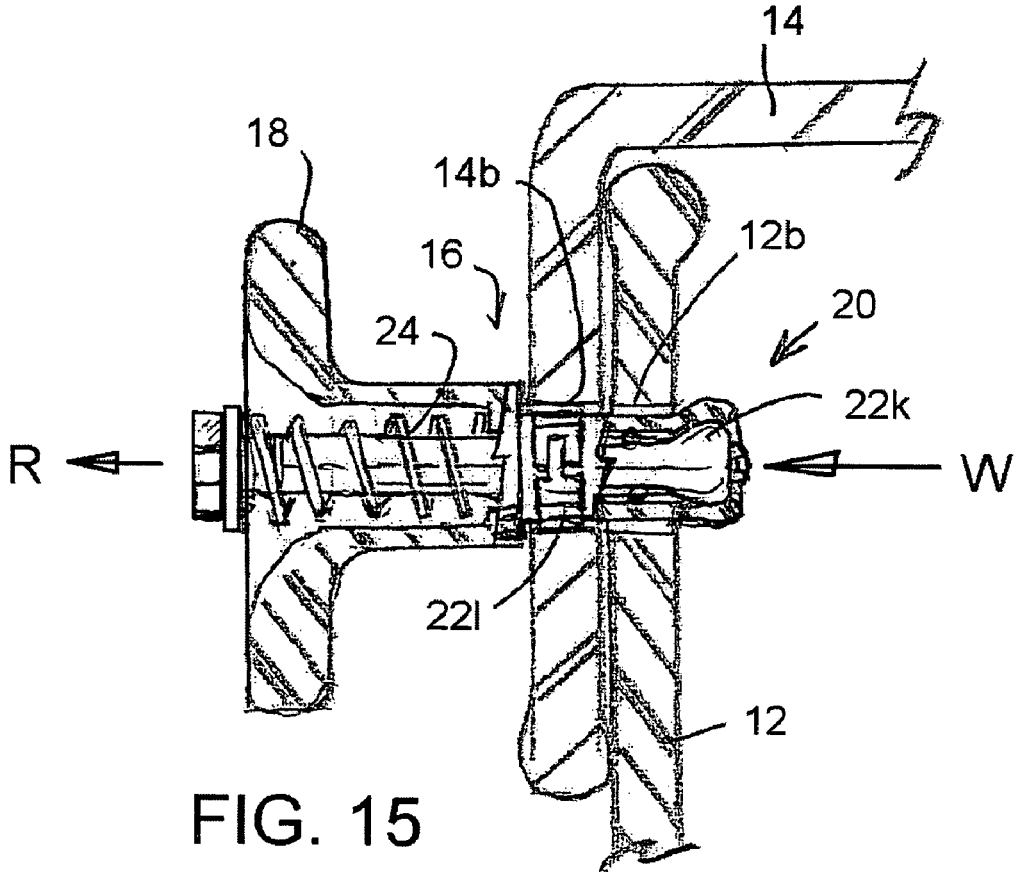
FIG. 15

FIG. 16
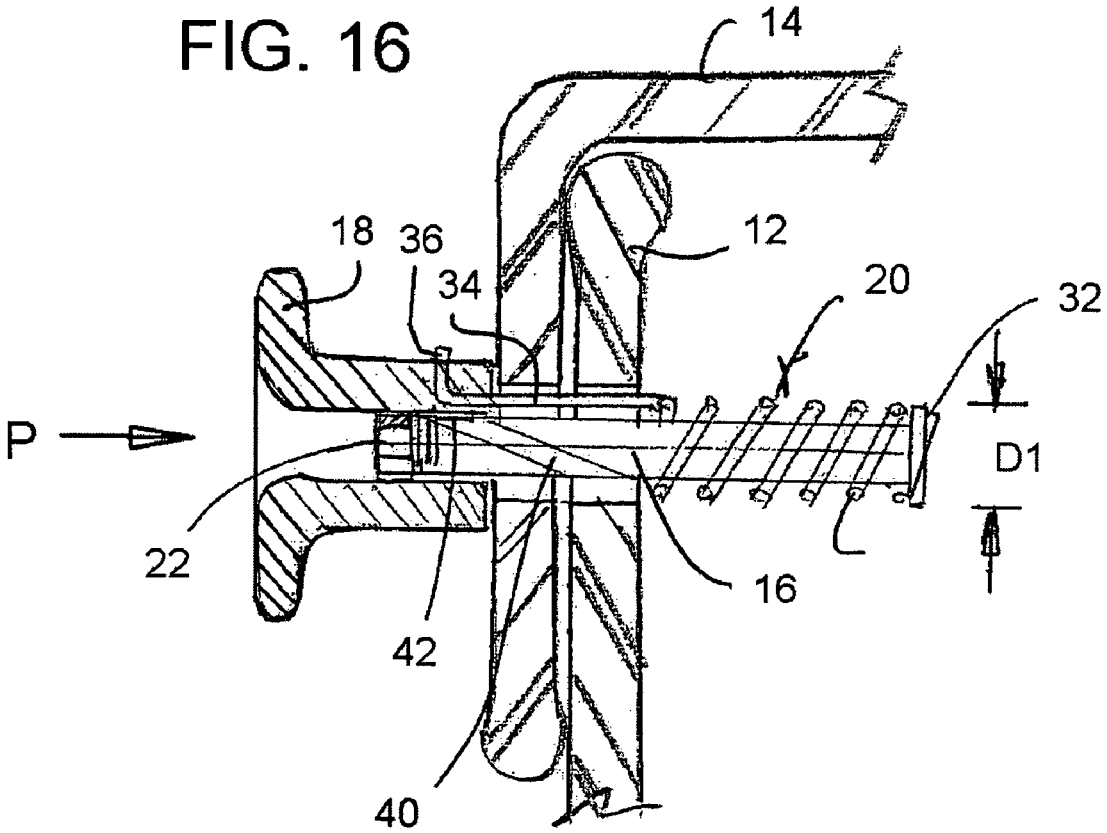
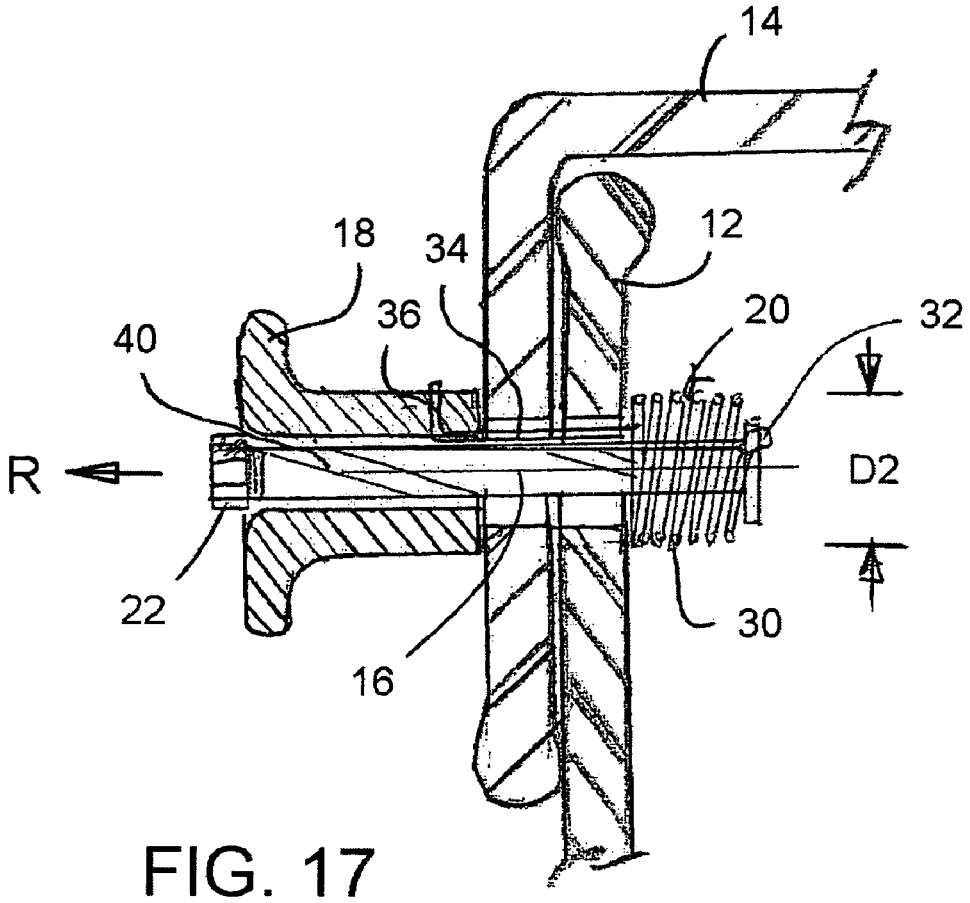
FIG. 17

ANTI-ANIMAL CONTAINER LOCK

CROSS REFERENCE TO RELATED APPLICATION

This is a divisional of application Ser. No. 10/119,358 filed Apr. 9, 2002 and now U.S. Pat. No. 6,722,711.

FIELD AND BACKGROUND OF THE INVENTION

The present invention relates in general to locking mechanisms, and, in particular, to a new and useful locking mechanism for containers having bodies and lids with overlapping portions, or cabinets or drawers with overlapping parts, and especially for outside receptacles such as trash cans and recycled bins.

The present invention solves the problem of keeping animals out of household trash containers thus preventing the mess that often is the result of an animal getting into the garbage can and rummaging through the contents of the container. The present invention can also keep young children out of drawers or cabinets.

Others have attempted to incorporate locking mechanisms in the design of a trash receptacle, such as hinged handles that engage grooves or ridges in the cover to inhibit the removal of the lid, or straps that attempt to hold the lid in place, or even levers that clamp the cover onto the container while in the upright position. See, for example: U.S. Pat. No. 2,717,167 for a Container Cover fastener; U.S. Pat. No. 3,363,924 for a Releasable Tension holder for Removeable Receptacle Covers; U.S. Pat. No. 3,935,964 for Trash Can Protector; U.S. Pat. No. 4,384,656 for Trash Receptacle Having Lid Fastening Means; U.S. Pat. No. 4,489,851 for Container Cover Lock; U.S. Pat. No. 4,534,488 for Locking Device for Garbage Can Lid; U.S. Pat. No. 4,666,054 for Animal Proof Storage Container Apparatus; U.S. Pat. No. 5,118,144 for Garbage Can Lid Latch; U.S. Pat. No. 5,411,161 for Container Having Twist-Locking Cover; U.S. Pat. No. 5,419,598 for Lock for Trash Bins; U.S. Pat. No. 5,474,341 for Gravity Actuated Container Lock; U.S. Pat. No. 5,599,050 for Lid-Locking Device for Trash Containers; U.S. Pat. No. 6,290,093 for Device for Locking the Cover of a Container, and Container So Equipped; and U.S. Pat. No. 6,339,944 for Locking Mechanism for Trash Can Receptacle and Other Doors.

The problem with prior designs is that they fail to function if the can is knocked over, and the animal can then use one or more limbs to paw their way to "unlock" the securing mechanism. The present invention takes advantage of the fundamental difference between primate and non-primate animals. The fact that primates have an opposing digit makes it impossible for non-primates to release the "lock" mechanism of the invention and then remove the lock to permit opening of the cover.

Various locking mechanisms are known and used in a variety of other fields as well. U.S. Pat. No. 6,077,011, for example, discloses a Push Button Panel Fastener, which utilizes captured balls that can be engaged against the recess of a pin for detachably connecting two parts to each other.

SUMMARY OF THE INVENTION

An object of the present invention is to provide a container lock which is easily and quickly engaged to lock the lid of a container in place, but which cannot be removed by the type of animals which would normally raid garbage pails, such as racoons and the like particularly, and generally cannot be removed by any non-primate nor by young children who have not yet developed adequate manual dexterity.

In accordance with the present invention, the lock has a part which must first be pushed and held, and then, while holding the lock, the lock is pulled to disengage it from the container, drawer or cabinet. This push-plus-pull action is impossible for a non-primate and small children to execute, yet provides for quick engagement and quick disengagement.

Another practical use of the invention, therefore, is to provide a safe and effective way to keep the cover on any container where it has or can be made to have overlapping components to be secured. An example is a plastic utility bin where the lid has a rim that overlaps the body of the container. The invention prevents the cover from being dislodged and the contents of the bin from spilling, without intentionally "unlocking" the mechanism and removing it from the container. Such boxes would be securely closed even if they were to fall from a shelf. Even containers that do not have overlapping parts could be secured if a small modification were made, or added to the container, such as two angles added in such a way that one leg of each angle overlaps and the lock of the invention is extended into aligned holes in the overlapping legs.

The invention could also be used to keep young children out of such containers since they may not yet possess the coordination to successfully release the mechanism. The mechanism could be used on cabinet doors to keep toddlers from getting into undesired areas of the homes as well. Other uses include the securing of cabinet doors and drawers on recreational vehicles like boats and mobile home. The term "receptacle" is used here to be generic for any container, cabinet, drawer receiving or the like, and the term "cover" includes a container lid, a cabinet door, a drawer front or the like.

Accordingly, an object of the present invention is to provide a locking arrangement for a receptacle having a cover, the receptacle and cover having overlapping parts, the locking arrangement comprising, a bolt for extending through aligned holes in the overlapping parts of the receptacle and cover, a handle at one end of the bolt for engagement for pulling the bolt out of the aligned holes in a withdrawing direction, the handle being outside the receptacle when the bolt extends through the aligned holes, expansion means at an opposite end of the bolt for expanding to an expanded geometry having at least one dimension which is greater than a dimension of the aligned holes to prevent withdrawing the bolt from the aligned holes, the expansion means having a contracted geometry which is at most equal to the dimension of the aligned holes for allowing withdrawing of the bolt from the aligned holes. A far or opposite end of the bolt extends inside the receptacle when the bolt extends through the aligned holes. The lock has an actuator mounted for linear movement to the bolt and engaged with the expansion means for moving the expansion means from the expanded geometry to the contracted geometry when the actuator is pushed in an unlocking direction which is different from the withdrawing direction, and biasing means engaged with the expansion means for biasing the expansion means toward the expanded geometry so that when the actuator is not being pushed in the unlocking direction, the expansion means is in the expanded geometry.

The present invention effectively prevents all non-primate animals and small children from being able to remove the cover from virtually any home-style, outdoor garbage can, or any other container where the cover or lid overlaps part of the body of the container, or can be made to overlap as described above. A garbage can is used for descriptive purposes. The can requires a small modification which is the perforation of the cover and the closing lip of the can where the two components overlap, by a pair of aligned holes. The typical home-style trash container has a cover that fits over and around the outside of the body of the container. A relatively small hole is drilled through the cover and container which can be simply accomplished using a standard household drill, or hand reamer. The invention will however, work, equally well should there be a container in which the cover fits inside the can.

The following description is based on the general trash can design where the cover fits on and over the can.

The aligned holes can be in any receptacle and cover whether it be a trash can, a recycle bin, a lock box, or any other container plus lid combination. As noted, the term "receptacle" is used in its broadest sense to include such enclosures as cabinets, drawers and other enclosure in furniture where the "cover" corresponds to a door for the cabinet, a front of a drawer or other structure in furniture. The only requirement of the present invention is that parts of the "receptacle" and "cover" overlap each other and have aligned holes for receiving what is generically referred to a bolt in the context of the present invention.

The expansion means may be bellows, a plurality of V-shaped members that expand or contract in the direction of the diameter of the bolt, a washer or multiple washers which expand or contract in the radial direction, a disk which is mounted in an off-set position at the end of the cylindrical bolt and which can move into misalignment with the bolt for expanding the geometry of the bolt and thus preventing its withdrawal from the aligned holes, an elastic tube with expansion boss inside, a coil spring or a variety of other geometries both disclosed and undisclosed.

One expansion means of the present invention utilizes one or more ball bearings or spheres to expand the geometry of the bolt. When used in the environment of a trash can as the receptacle, the hole through the can, can be fitted with an escutcheon type keeper plate that has a hole which is slightly larger in diameter than the locking bolt. This is needed especially with certain embodiments the invention and with plastic trash containers. The locking bolt, also hollow, houses a mechanism that includes, at least one ball bearing, a spring, a cam rod. When at rest the spring holds the cam rod in the locked position which presses the ball bearing outwardly so that part of the bearing projects through a hole in the outer bolt. When at rest the bearing effectively increases the diameter of the locking bolt preventing it from passing through the keeper plate. A release button for the bolt can be recessed in the handle, shielded, or positioned, in such a way as to require the use of an opposing digit to activate the release and still withdraw the bolt by its handle through the keeper in the can.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a sectional view of a first embodiment of the invention in a position for insertion into the aligned holes in a receptacle and cover with overlapping parts;

FIG. 2 is a view similar to FIG. 1 of the locking arrangement in a locked condition;

FIG. 3 is a view similar to FIG. 1 of the locking bolt of the present invention withdrawn from the aligned holes;

FIG. 4 is a view similar to FIG. 1 of a second embodiment of the invention;

FIG. 5 is a view similar to FIG. 2 of the second embodiment of the invention;

FIG. 6 is a view similar to FIG. 1 of the third embodiment of the invention;

FIG. 7 is view similar to FIG. 2 of the third embodiment of the invention;

FIG. 8 is an enlarged detail of the embodiment of FIG. 6;

FIG. 9 is an end view of the embodiment of FIG. 6;

FIG. 10 is a view similar to FIG. 8 showing expansion means in the expanded geometry for the embodiment of FIG. 6;

FIG. 11 is a view similar to FIG. 9 showing the expanded geometry;

FIG. 12 is a view similar to FIG. 1 of a still further embodiment of the invention;

FIG. 13 is a view similar to FIG. 2 of the embodiment of FIG. 12 in the locked position;

FIG. 14 is a view similar to FIG. 1 of another embodiment of the invention;

FIG. 15 is a view similar to FIG. 2 of the embodiment of FIG. 14 in the locked position;

FIG. 16 is a view similar to FIG. 1 of a still further embodiment of the invention;

FIG. 17 is a view like FIG. 2 of the still further embodiment; and

FIG. 18 is a view similar to FIG. 7, showing a variant of the third embodiment.

DESCRIPTION OF THE PREFERRED EMBODIMENTS

Referring to the drawings in particular wherein the same reference numerals are utilized to designate the same or functionally similar parts, the invention disclosed in FIGS. 1, 2 and 3 is a locking arrangement generally designated 10 for a receptacle 12 having a cover 14. The receptacle and cover 12 and 14, have overlapping parts 12*a* and 14*a* with aligned holes 12*b* and 14*b* therethrough. The holes may be any shape but circular holes are preferred since they can easily be made by a household drill passing through the overlapping parts.

The locking arrangement of the invention comprises a bolt 16 for extending through the aligned holes 12*b*, 14*b* in the overlapping parts 12*a*, 14*a* of the receptacle and cover. Bolt 16 has a handle 18 at one end of the bolt for engagement for pulling the bolt out of the aligned holes in a withdrawing direction W in FIG. 3. The handle and the first end of the bolt to which the handle is connected, are outside the receptacle when the bolt extends through the aligned holes as illustrated in FIGS. 1 and 2.

Expansion means 20 are provided at an opposite, inside end of bolt 16 for expanding into an expanded geometry shown in FIG. 2, having at least one dimension, in this case diameter, which is greater than a dimension of the aligned holes, again the diameter of the holes, to prevent withdrawing the bolt from the aligned holes 12*b*, 14*b*.

The expansion means 20 also have a contracted geometry shown in FIG. 1, which is at most equal to the dimension of the aligned holes for allowing withdrawing of the bolt from the aligned holes as shown in FIG. 3.

An actuator, such as a shaft or rod 22, is mounted for linear movement to the bolt 16, and engages the expansion means 20 for moving the expansion means from the expanded geometry of FIG. 3, to the contracted geometry of FIG. 1, when the actuator is pushed in an unlocking direction P which is opposite from the withdrawing direction W.

Biasing means, such as a spring 24, is operatively engaged with the expansion means 20 for biasing the expansion means toward the expanded geometry of FIG. 2, so that when the actuator is not being pushed in the unlocking direction P, the expansion means is in the expanded geometry. The operative engagement in the embodiment of FIGS. 1 to 3 is actually between a large diameter part 22*a* of the actuator rod 22, and an inside step 16*a* of the bolt 16.

In the embodiment of FIGS. 1–3, expansion means 20 comprises a bellows or flexible sleeve 20*a* having one or more repeats of V-shaped sides. The top 20*b* of bellows 20*a* is fixed to the inner end of the actuator rod 22 by, for example, a screw 20*c*. The inner end 20*d* of the bellows is attached to the inner end of bolt 16. As shown in FIG. 1, when a user pushes actuator 22 in the pushing direction P, this compresses spring 24 and pushes the inner end 20*b* of bellows 20*a* inwardly in the same direction and into the receptacle 12 through the aligned holes. Since the outer end 20*d* of the bellows is fixed to bolt 16 and further because bolt 16 has a large diameter portion 16*b* which allows only part of the bolt to extend through the aligned holes, bellows 20*a* is moved to its contracted or elongated geometry. This reduces the outer diameter of the bellows so that the bolt 16 along with the bellows can be inserted into the aligned holes. FIG. 3 which shows the locking arrangement removed, also illustrates the condition of the locking arrangement before it is inserted into the aligned holes 20*b*, 14*b*.

FIG. 2 illustrates the condition when the actuator 22 is released, allowing it to move into the release direction R under the influence of spring 24. This also moves the end 20*b* of bellows toward its opposite end 20*d*, thus increasing the effective diameter of the bellows 20*a*. The effective diameter of the bellows now being larger than the diameter of either or both of aligned holes 12*b* and/or 14*b*, bolt 16 cannot be withdrawn.

This produces a simple, quick acting yet effective locking of the cover 14 to the receptacle 12.

FIG. 3 illustrates the withdrawal of the locking arrangement which involves first pushing the actuator in direction P and then pulling the entire assembly in withdrawal direction W. This push/pull combination cannot be executed by any non-primate animal and effectively locks the container against such animals.

According to the present invention one, two or more of the locking arrangements can be used around the perimeter of a trash can or other receptacle, or alternatively a single locking arrangement may be sufficient depending on the geometry of the container or receptacle.

When used to lock a cabinet, for example, a single locking arrangement would be sufficient when it extends through the aligned holes of, for example, a cabinet frame and cabinet door.

FIGS. 1–3 can also serve to illustrate a case where the expansion means rather than being a bellows that extends 360° around the end of the actuator 22, is one or more V-shaped projections which have one end 20*d* fixed to the inner end of actuator 22 and an outer end connected to the inner end of bolt 16. The handle may also be cut or have a recess to accept the thumb as it pushes the actuator.

As also shown in FIGS. 1–3, handle 18 may be T-shaped and extend from opposite sides of bolt 16, or may be disc shaped extending 360° around the end of bolt 16 or constitute multiple projections extending radially, outwardly from bolt 16.

The only essential is that a person be able to grasp the handle to pull it into the withdrawal direction W and, and the same time push actuator 22 in a pushing direction P.

FIGS. 4 and 5 illustrate another embodiment of the invention. In this embodiment, handle 18 is nothing more than a tapered enlargement of the cylindrical bolt 16 so that a user can simply engage handle 18 with the index and center finger while pushing actuator 22 in the direction of arrow P using the thumb.

The handle 18 also has a flared front end 18*a* which partially or completely covers the outer end 22*a* of actuator 22 even in its retracted position of FIG. 5. This prevents inadvertent pressing of the actuator in the direction P and possible accidental removal of the locking bolt.

Actuator 22 in the embodiment of FIGS. 4 and 5, includes a small diameter portion 22*b* that extends into a hollow small diameter portion 16*c* of bolt 16. The inner end 22*c* of actuator 22 engages a spring 24 compressed within a blind bore or end of bolt 16*b*. Spring 24 biases actuator 22 in the direction of arrow R in FIG. 5.

Small diameter portion 22*b* of actuator 22 includes a further smaller diameter portion 22*d* that is positioned and sized to allow a pair of ball bearings or balls 20*e* to be retracted so that no part of either ball 20*e* extends beyond the outer circumference of small diameter portion 16*c* of bolt 16. This allows the small diameter portion 16*c* to be inserted and withdrawn into and from the aligned holes 12*b*, 14*b*, with the insertion stopping when the end 16*b* of large diameter part of bolt 16 engages the outer surface of overlapping portion 14*a* of cover 14.

As shown in FIG. 5, the larger diameter portion 22*c* of the actuator 22 engages against the inner surfaces of ball bearings 20*e* when actuator 22 is pushed outwardly in the direction of arrow R by spring 24, to bring the expansion means 20 of this embodiment of this invention into its expanded geometry, namely with at least part of the outer circumference of balls extending out beyond an opening in a plate 20*f* secured against the inner surface of overlapping portion 12*a* of receptacle 12. Especially when the receptacle and cover are made of plastic, the openings 12*b*, 14*b* may not be accurate enough to stop withdrawal of the locking arrangement. A more accurately formed hole in plate 20*f* solves this problem and should be used with the embodiment of FIGS. 4 and 5, or a hollow retaining nut.

FIGS. 6–11 show a further embodiment of the invention where expansion means 20 comprises a cylindrical disc 20*g* pivotally mounted at an acentric pivot pin 20*h* to the end of cylindrical extension 16*c* of bolt 16. Disc 20*g* has an inner concave cam surface 25 which, with actuator 22 pressed against the spring 24 in the direction of arrow P in FIG. 6, sits in the deepest part of the recess and tends to center disk 20*g* on the bolt extension 16*c* as shown in FIG. 8. To this end, actuator 22 has a semi-spherical inner end 22*e*. Under the action spring 24 actuator 22 moves in the direction of arrow R in FIG. 7 and, as shown in FIG. 10, disk 20*g* falls by gravity (or by action of a spring—not shown) into misalignment with bolt end 16*c* to thus expand the geometry of the expansion means 20 and prevent withdrawal of the bolt from the aligned holes in the overlapping parts of the container and lid.

FIG. 18 illustrates a variant of the third embodiment wherein the actuator 22 is movable laterally of the axis of the bolt 16 and the pull direction P. The actuator is a push button mounted for movement in the handle 18 and movable against a cam part 20*m* at the end of an off-center shaft 20*h*. Shaft 20*h* is rotatable in bolt 16 and has an opposite end that carries the disc 20*g*. Spring 24 in handle 18 engages cam 20*m* or shaft 20*h* to bias the shaft in a rotation direction to off-set the disc 20*g* in the aligned holes in receptacle and lid, 12, 14 (this is the expanded geometry). Actuator 22 is pushed in the direction of arrow R' in FIG. 18 to rotate shaft 20*h* to move disc 20*g* to a centered position on the aligned holes (the contracted geometry) so the lock can be withdrawn from the aligned holes.

FIGS. 12 and 13 show a further embodiment of expansion means 20, this time in the form of a compressible washer or ring 20*j* held on a small diameter portion 22*f* at the inner end of actuator 22 and a washer 22*g* attached, for example, via screw 22*h*, to the end of actuator 22. FIG. 12 shows the contracted position of the expansion means 20 when actuator 22 is pressed against spring 24 in the direction of arrow P to allow washer 20*j* to take its small diameter geometry.

FIG. 13 shows the effect of spring 24 which moves actuator 22 in the direction of arrow R thus causing washer 22*g* to squash washer 20*j* and move it to its expanded geometry which is larger in diameter than the diameter of either or both aligned holes 12*b*, 14*b*.

As a safety, in the case where the expansion means 20 is jammed or broken and cannot be release from its expanded geometry, outside parts of the bolt and handle can be disassembled so that the locking parts of the invention can simply be pushed into the receptacle to remove the cover.

In FIG. 13, such safely means are in the form of a threaded part 18*a* of handle 18, threaded onto the small diameter part 16*a* of bolt 16. Two flat bottomed slots 16*d* are cut into opposite sides of the cylindrical bolt portion 16*a*. These areas can be engaged by a spanner wrench or the like to hold the bolt 16 from rotating while the handle 18 is unscrewed. Once unscrewed the bolt 16, actuator 22 and expansion means 20 can be pushed into the receptacle 12 through the holes 12*b*, 14*b* to unlock the lid 14. This or other safety means can also be provided on the other embodiments of the invention.

FIGS. 12 and 13 also illustrate a feature of the invention that can be shared by any embodiment of the invention, namely the recessed nature of the push-button end 22*a* of actuator 22 inside the perimeter of handle 18 even when the actuator is release (FIG. 13). Handle 18 is shaped with an enlarged entry area for the actuator so that despite the recessed push-button portion 22*a*, the thumb of a user of the invention can still push the actuator in the direction P to insert the lock in place (FIG. 12).

FIGS. 14 and 15 illustrate a further embodiment of the invention wherein expansion means 20 are in the form of an elastic, e.g. latex, tube 20*k* having an outer end clamped to a small diameter bolt portion 16*e* of the bolt by an outer side clamp 20*l*. The outer surface of bolt portion 16*e* may be serrated or have teeth angled toward the left in FIG. 14, to help retain tube 20*k* on bolt portion 16*e*.

Actuator 22 in this embodiment, has an outer threaded end with a nut 22*i* threaded thereon and a screwdriver slit 22*j* therein. A boss or smooth enlargement 22*k* is provided at the opposite end of actuator 22. Boss 22*k* extends out through the open inner end of tube 20*k* in the contracted geometry or position of means 20 shown in FIG. 14. One or more lubrication or lubricating donuts 22*l* engage around actuator 22 in the chamber formed between bolt portion 16*e* and the boss 22*k*, to spread lubricant over the inner surface of the tube and the outer surface of the actuator. This helps the smoothly increasing diameter of boss 22*k* slide into the open end of tube 20*k* to expand it into the expanded geometer or position of FIG. 15, when return spring 24 return actuator 22 to its rest position in the direction R.

Expansion of tube 22*k* increases its outside diameter to a dimension that is larger than the diameter of at least one of the hole 12*b* and 14*b*, to lock the device in the aligned holes. As with the other embodiments of the invention, removal requires the push/pull action the withdraw the bolt in to direction of arrow W in FIG. 15.

The embodiment of FIGS. 16 and 17 is a simplified version of the invention which is still fully functional.

Handle 18 can have front and rear slots so that the actuator in the form of a nut 22 screwed to the end of a bolt 16, can be pushed in the direction of arrow P. This extends the right hand end of the bolt which is fixed to one end 32 of a coil spring 30. The opposite end of the coil spring 30 has been lengthened and straightened at 34 and extends out through the aligned holes to a bend 36 that is fixed to the handle 18. This stabilizes the left hand end of the coil spring and allows it to stretch when bolt 16 is pushed in the direction of arrow P. This stretching reduces the diameter of the coil spring 30 to a smaller diameter D1 which is equal to or smaller than the aligned holes in the receptacle and lid 12, 14. This reduction in diameter of the coil spring can be enhanced further by providing a helical groove 40 with very long pitch that receives a projection 42 extending inwardly from handle 18. Thus, when actuator 22 is pushed, there is a relative rotation between the handle 18 and the bolt 16 in the winding direction of the coil to further reduce its diameter.

FIG. 17 shows the release direction where actuator 22 is released in the direction of arrow R. This results in coil spring 30 taking on a larger diameter D2, which is larger than the aligned holes in the receptacle and lid.

Handle 18 can be shaped so that at all times all parts of the bolt 16 and actuator 22 remain within the confines at least of the sides of the handle 18 to avoid inadvertent releasing of the lock. In addition, actuator 22 can be nothing more than a nut threaded onto the end of bolt 16. The advantage of this is that in case the lock becomes caught in the receptacle, nut 22 can be unscrewed and the entire bolt 16 with its coil spring 30 can be pushed into the receptacle to permit removal of lid 14.

While specific embodiments of the invention have been shown and described in detail to illustrate the application of the principles of the invention, it will be understood that the invention may be embodied otherwise without departing from such principles.

What is claimed is:

1. A locking arrangement comprising:

a receptacle having a cover, the receptacle and cover having overlapping parts with aligned holes therein;

a handle for engagement for pulling the locking arrangement from the aligned holes in a withdrawing direction, the handle being outside the receptacle and having an enlarged portion for being held by one hand of a user of the locking arrangement;

an actuator mounted for movement to the handle and having a first end for being outside the receptacle and a second end for being inside the receptacle, the actuator extending through the aligned holes for locking the overlapping parts together;

expansion means at the second end of the actuator for expanding to an expanded geometry having at least one dimension which is greater than a dimension of the aligned holes to prevent withdrawing the actuator from the aligned holes when the actuator is pushed in an unlocking direction that is opposite to the withdrawing direction, the expansion means having a contracted geometry which is at most equal to the dimension of the aligned holes for allowing withdrawing of the actuator from the aligned holes;

biasing means engaged with the expansion means for biasing the expansion means toward the expanded geometry so that when the actuator is not being pushed, the expansion means is in the expanded geometry, the biasing means acting to bias the actuator in a releasing direction that is the same as the withdrawing direction; and release means connected to the actuator for reducing the effective diameter of an outer end of the actuator to allow the actuator to be pushed through the handle and into the receptacle so that the cover can be removed in case the locking arrangement becomes caught in the aligned holes, said release means comprising the actuator having the outer end thereof threaded and including a nut threaded on the outer threaded end of the actuator and a screwdriver slit in the outer threaded end of the actuator for holding the actuator against rotation when the nut is un-threaded from the outer threaded end to remove the nut and thereby reducing the effective diameter of the outer end of the actuator.

2. A locking arrangement according to claim 1, including a bolt extending from the handle and at least partly into the aligned holes, said bolt having an opening and said actuator being slidably mounted in the opening.

3. A locking arrangement according to claim 2, wherein the expansion means comprises a flexible sleeve connected between one end of the bolt and the second end of the actuator.

4. An arrangement according to claim 2, wherein the biasing means comprises a spring for biasing the actuator in the releasing direction out of the bolt and away from an interior of the receptacle.

5. An arrangement according to claim 2, wherein the expansion means comprises at least one V-shaped member connected between the second end of the actuator and the end of the bolt.

6. An arrangement according to claim 2, wherein the expansion means comprises a deformable and expandable tube engaged to the bolt and an expanding boss at the inner end of the actuator for expanding the tube.

7. An arrangement according to claim 1, wherein the release means comprises threaded release means for removing part of the actuator.

* * * * *